US005433275A

United States Patent [19]

Melenyzer et al.

[11] Patent Number: 5,433,275

[45] Date of Patent: Jul. 18, 1995

[54] DOUBLE-THREADED ANCHOR TUBING ASSEMBLY

[75] Inventors: George J. Melenyzer, Humble; J. Lindley Baugh; Kevin O. Trahan, both of Houston, all of Tex.

[73] Assignee: Baker Hughes Incorporated, Houston, Tex.

[21] Appl. No.: 276,937

[22] Filed: Jul. 19, 1994

[51] Int. Cl.[6] ..... E21B 19/16

[52] U.S. Cl. ..... 166/380; 166/382; 166/117.6; 166/124

[58] Field of Search ..... 166/117.6, 123, 208, 166/378, 380, 382, 124, 206

[56] References Cited

U.S. PATENT DOCUMENTS

| | | | |
|---|---|---|---|
| 3,990,510 | 11/1976 | DeCuir | 166/128 |
| 4,345,649 | 8/1982 | Baugh et al. | 166/387 X |
| 4,375,240 | 3/1983 | Baugh et al. | 166/387 |
| 4,685,523 | 8/1987 | Paschal et al. | 166/378 |
| 4,928,768 | 5/1990 | Peterson | 166/380 |
| 5,332,038 | 7/1994 | Tapp et al. | 166/123 X |

OTHER PUBLICATIONS

Composite Catalog, Baker Oil Tools Co., Seal Bore Packers, pp. 494–501 (1984–1985).

Baker Oil Tools Advertising, Permanent Packer Systems, 4 pages.

Brown Oil Tools, Inc. (BOT) Advertising, pp. 1177–1179.

Baker Packers Advertising, pp. 672 & 673.

*Primary Examiner*—Roger J. Schoeppel

*Attorney, Agent, or Firm*—Browning, Bushman, Anderson & Brookhart

[57] ABSTRACT

An anchor assembly may be used for interconnecting a downhole tubular member with a packer affixed within a well bore. The anchor assembly may include a mandrel fixedly secured to production tubing, and a collet mechanism axially movable relative to the mandrel. The collet mechanism may have a plurality of axially extending collet fingers each having a first plurality of threads for mating engagement with the packer mandrel threads and a second plurality of threads for mating engagement with the anchor assembly mandrel threads. A sealed member is provided for sealing engagement between the mandrel and the downhole packer. The anchor assembly of the present invention allows substantial axial forces to be transmitted between the production tubing and the set packer without risking collapse of the packer mandrel or failure of the bearing surfaces between the production tubing mandrel and the collet mechanism.

20 Claims, 2 Drawing Sheets

DOUBLE-THREADED ANCHOR TUBING ASSEMBLY

FIELD OF THE INVENTION

The present invention relates to anchor latch assembly of the type used in hydrocarbon recovery operations. More particularly, this invention relates to a downhole anchor tubing seal assembly suitable for running into a well on a production tubing string for engagement with threads on the upper end of a packer, thereby structurally interconnecting the packer and the production tubing string.

BACKGROUND OF THE INVENTION

Those skilled in hydrocarbon recovery operations have long recognized the benefits of quickly and reliably interconnecting a downhole tubular, such as production tubing, with a fixed downhole tool, such as a packer that has been set in the well bore. For various reasons, it may be desirable or essential to set a packer within a well bore, then subsequently connect the previously connected tubular string or another tubular string to the set packer. Typically this interconnection of the production tubing string and the packer is accomplished with an anchor tubing seal assembly, and various models of anchor tubing seal assemblies have been devised for interconnection with specific types of packers. A structural interconnection may thus be made between internal threads on the upper end of a packer and mating external threads on the anchor tubing,, seal assembly suspended from the lower end of a production tubing string. The same anchor tubing seal assembly may be used to structurally interconnect downhole equipment other than packers with various types of tubular goods, such as tail pipes. A subsequent disconnection between the production tubing string and the packer may be accomplished by rotating the tubular string in the direction which will not break apart the threads along the production tubing string.

Anchor tubing seal assemblies have for decades employed a collet that is axially movable relative to the anchor assembly mandrel to interconnect the anchor tubing seal assembly and the upper mandrel of a packer or similar downhole tool fixed within the well bore. The anchor assembly collet fingers may have exterior threads for mated engagement with the interior threads on the upper mandrel of a packer. When the collet fingers are axially in their engaged position, the collet fingers are prevented from moving radially inward relative to the anchor assembly mandrel threads, so that a fixed structural engagement of the collet threads and the packer mandrel threads are obtained. While in the disengaged position, the collet fingers are allowed to move radially relative to the anchor assembly mandrel threads, so that the collet fingers may ratchet down the packer mandrel threads as the anchor assembly mandrel moves axially with respect to the set packer. The collet may be shifted axially to its engaged position by picking up on the production tubing string, so that a tapered surface in the anchor assembly mandrel prevents the collet fingers from moving radially inward, thereby reliably interconnecting the packer and the production tubing string. Production fluid may then be transmitted through the packer and into the production tubing, which is sealingly connected to the packer by a seal assembly in the anchor assembly. To release the production tubing from the packer, the production tubing; and the interconnected collet fingers may be rotated at the surface to unthread the anchor assembly from the packer.

The acceptance of anchor tubing seal assemblies has been limited in part because high axial forces cannot be reliably transmitted through the interconnected anchor tubing seal assembly. If the well operator desires to transmit high axially "pick up" force on the packer, the taper of the acute angle on the engaging collet and the mating anchor assembly mandrel affects the amount of radially outward force placed on the upper threads of the packer mandrel. If these radially inward forces become too high, the tubing mandrel may collapse, resulting in an expensive replacement operation. To lower this collapsing force on the tubing mandrel, the angle of this taper may be increased, e.g., from 30° to 45° . As this angle is increased, however, the bearing surface area between the collet fingers and the anchor assembly mandrel decreases, which decreases bearing strength. Since high stresses must be transmitted through these bearing surfaces, a decrease in the surface area increases the likelihood of permanent bearing surface deformation and thus beating failure.

The disadvantages of the prior art are overcome by the present invention. Improved techniques are hereafter disclosed for reliably interconnecting a tubular member, such as production tubing, to a fixed downhole tool, such as a packer, while enabling high axial forces to be applied to the fixed downhole tool through the tubular member without risking collapse of the tubing mandrel.

SUMMARY OF THE INVENTION

According to a suitable embodiment of the invention, an anchor tubing seal assembly includes a collet mechanism with two sets of radially spaced threads. The axially extending radially outer set of threads is provided for mating engagement with the internal threads on the packer mandrel (or similar downhole tool). The axially extending and radially inner set of threads on the collet mechanism are provided for mating engagement with the threads on the anchor assembly mandrel (tubing mandrel) secured to the production tubing string. Stop surfaces may be provided at a fixed position with respect to the tubing mandrel and on the collet mechanism for limiting axial travel of the collet mechanism relative to the tubing mandrel. Stop surfaces on the tubing mandrel and on the packer mandrel may also limit axially downward travel of the tubing mandrel with respect to the packer mandrel. The mating tapered surfaces on the tubing mandrel/collet threads maintain the collet threads in engagement with the packer mandrel threads in response to an upward axial force transmitted between the production tubing and the packer. The axial load between the tubing mandrel and the collet mechanism is thus transmitted through the inner threads on the collet mechanism, rather than through end surfaces on the collet fingers. Accordingly, the radially inward force on the tubing mandrel is limited to prevent collapse of the tubing mandrel, and a large bearing surface area is provided between the tubing mandrel and the collet mechanism to prevent beating failure.

According to the method of the present invention, the anchor tubing seal assembly is threadably connected at the surface to a production tubing string, and the anchor tubing seal assembly then lowered into a well bore from the end of the production tubing. After the radially outer threads on the collet mechanism engage the radially inward threads on the packer mandrel, further downward movement of production tubing will cause the collet fingers to move radially inward and then snap back radially outward as the, collet threads ratchet down the threads of the packer mandrel. To allow this ratcheting action to occur, the collet fingers move radially with respect to the radially outward threads of the production tubing mandrel. Once the threads on the collet fingers are axially positioned at a desired securing location with respect to the threads on the packer mandrel, the production tubing may be picked up while the collet fingers remain axially in place, so that the upper tapered surface on the tubing mandrel threads engage the mating lower surface on the threads on the collet fingers. Forced engagement of these tapered surfaces prohibits subsequent radially inward :movement of the collet fingers, thereby effectively maintaining a reliable threaded connection between the collet mechanism and the production tubing mandrel, and between the collet mechanism and the packer. High pick up forces may subsequently be applied to the packer through the production tubing without risking collapse of the tubing mandrel. Equally important, the plurality of axially spaced threads on the collet mechanism and the mating threads on the tubing mandrel provide a large bearing surface area between the collet mechanism and the tubing mandrel, thereby substantially reducing the risk of bearing failure when high axial forces are transmitted between the production tubing and the packer.

It is an object of the present invention to increase the reliability of an anchor tubing seal assembly so that high axial loads may be reliably transmitted between downhole tubular members interconnected by the anchor assembly.

Another object of the invention is to allow high axial loads to be transmitted between downhole tubular members without risking collapse or failure of either the downhole tubular members or the anchor assembly.

A significant feature of the invention is that the collet of an anchor assembly may ratchet in a conventional manner into engagement with threads on one downhole tubular, and that the threaded connection of the collet and the tubing mandrel secured to the other downhole tubular member provides a large bearing surface area for significantly reducing the risk of beating failure.

A significant feature of the invention is that the taper on the engaging surfaces between the tubing mandrel and the collet fingers may be selected to reduce the radial forces acting on the other downhole tubular member without reducing the bearing surface area between the tubing mandrel and the collet.

An advantage of this invention is that the reliability of the anchor assembly may be significantly increased without a corresponding increase in the cost of the assembly.

These and further objects, features, and advantages of the present invention will become apparent from the detailed description, wherein reference is made to the figures in the accompanying drawings.

DETAILED DESCRIPTION OF PREFERRED EMBODIMENTS

Figure 1:
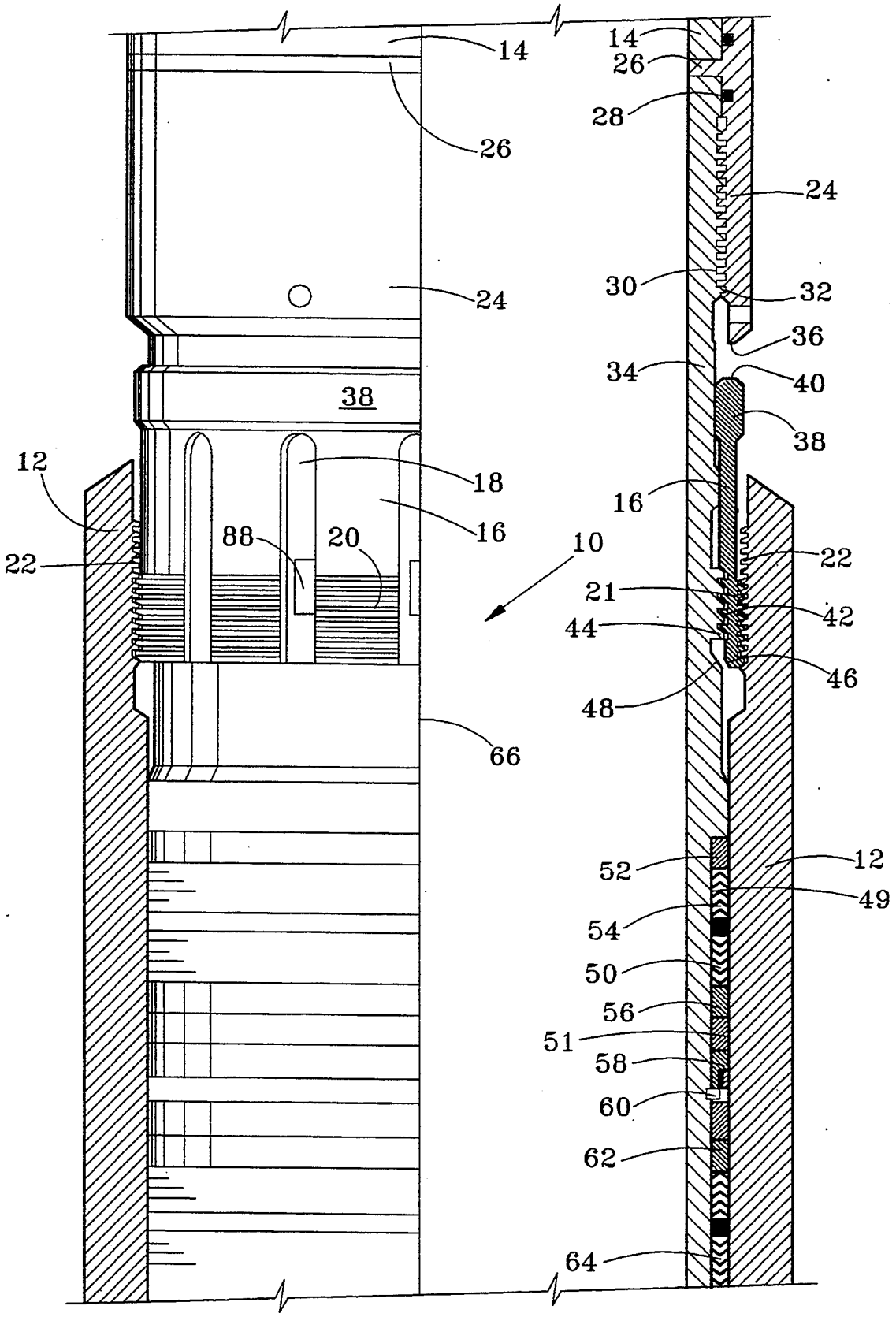
FIG. 1 is a half-sectional view illustrating an anchor tubing seal assembly according to the present invention interconnecting a production tubing string with a mandrel of a downhole packer.
Figure 2:
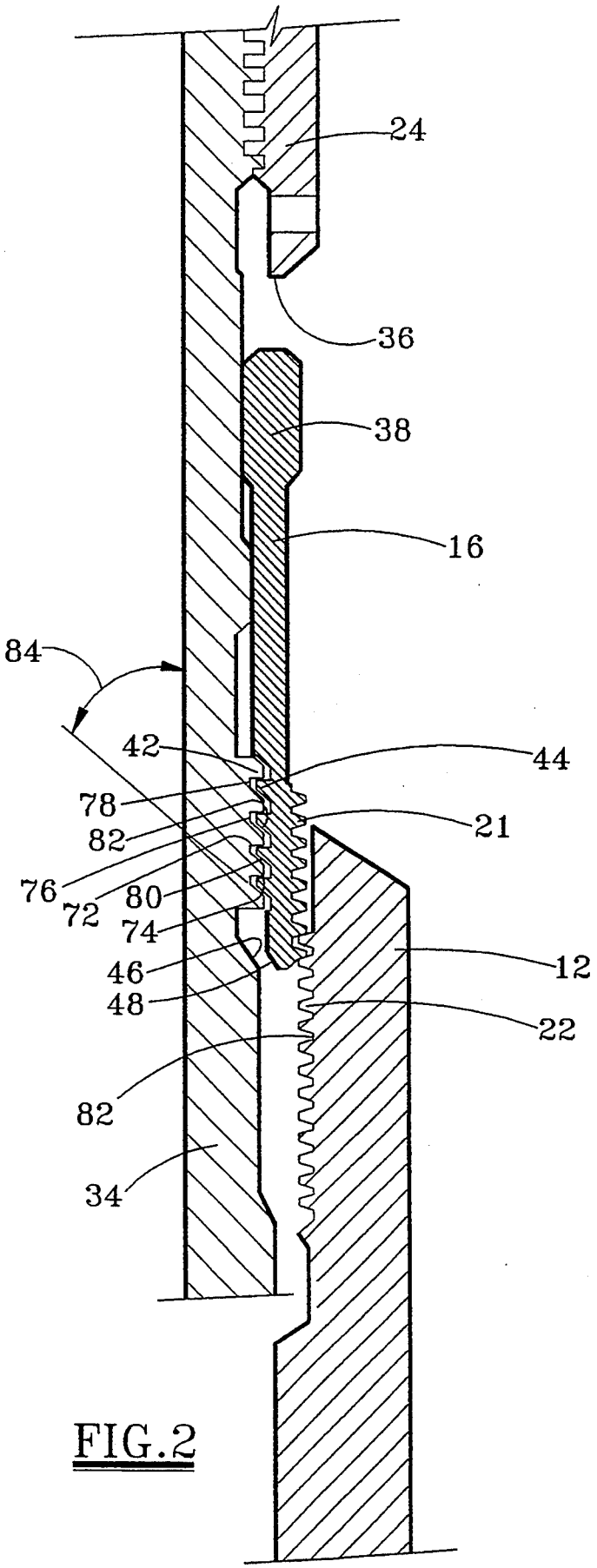
FIG. 2 is a cross-sectional view illustrating a portion of the anchor assembly shown in FIG. 1 prior to complete interconnection of the collet mechanism and the packer mandrel, and more particularly illustrating the taper of the threads on the collet fingers and the mating threads on the tubing mandrel and the packer mandrel.

A suitable embodiment of an anchor tubing seal assembly 10 is shown in FIGS. 1 and 2. While the anchor assembly 10 may be used for structurally connecting various downhole members, the operation is particularly described below for sealingly interconnecting a production tubing string with a packer that is set in a cased or uncased well bore. Accordingly, the anchor assembly 10 may be threadably connected at the surface to the lower end of production tubing 14, and may be positioned downhole from the production tubing string for securing the anchor assembly 10 and thus the production tubing 14 to an upper mandrel 12 of a set packer. Those skilled in the art will appreciate that various types of packers may be set within a well bore by various techniques, and that the packer (or its associated equipment) may conventionally include an upper mandrel 12 as depicted in FIG. 1.

For the embodiment depicted in FIG. 1, the lower end of production tubing 14 is interconnected with an anchor assembly mandrel or a tubing mandrel 34 by a top connector 24. The top connector 24 may include a radially outwardly projecting ring 26 sandwiched between the tubing 14 and the mandrel 34, and a pair of O-ring seals 28 for sealing engagement between the connector 24 and both the tubing 14 and mandrel 34. Radially inward threads 30 on the top connector mate with radially outward threads 32 on the mandrel 34, and similar threads (not shown) may structurally interconnect the production tubing 14 and the top connector 34. A stop surface 36 at the lower end of the top connector 24 limits axial travel of the collet discussed subsequently with respect to the production tubing string 14.

A collet mechanism comprising a plurality of circumferentially spaced collet fingers 16 and a collet ring 38 forms the structural interconnection of the mandrels 34 and 12, and thus the structural interconnection of the tubing string and the set packer. Adjoining collet fingers 16 are spaced apart by a respective axially extending slot 18. Each collet finger includes a lower portion 20 with both radially inward and outward threads discussed subsequently. The collet ring 38 and thus the fingers 16 affixed thereto are movable with respect to mandrel 34. The travel of ring 38 is limited to movement along axis 66 of the assembly 10 by maintaining close tolerances between the outer diameter of the ring 38 and the inner diameter of the adjoining surface of the mandrel 34. The top surface 40 on ring 38 may engage stop surface 36 to cause ratcheting movement of the assembly 10 relative to the packer mandrel 12, as discussed subsequently.

The lower end 20 of each collet finger includes both a radially internal thread 44 for mated engagement (at the surface of the well) with the external thread 42 on the mandrel 34, and radially external thread 21 for mated engagement downhole with the internal thread 22 on the lapper packer mandrel 12. In the position as shown in FIG. 1, the collet fingers have been securely latched to the packer mandrel by picking up the tubing 14 and thus the mandrel 34, so that the tapered surface on the threads 44 are brought into forced engagement with the corresponding tapered surface on the threads 42.

FIG. 1 also depicts a suitable seal mechanism for maintaining a fluid-tight seal between the tubing mandrel 34 and the packer mandrel 12. More particularly, the seal assembly as shown in FIG. 1 maintains a fluid-tight seal between an outer cylindrical surface 49 on a lower portion 50 of the mandrel 34, and a corresponding inner cylindrical surface 51 on the packer mandrel 12. A suitable seal assembly comprises a top metal backup ring 52, a top seal sub-assembly 54 including a plurality of stacked sealing rings 50 and an O-ring, an intermediate metal seal ring 56, a locking ring 58 which cooperates with a locking wire 60 having a rectangular cross-sectional configuration to prevent axial motion of the seal assembly with respect to the mandrel 34, a lower backup ring 62, and a lower seal sub-assembly 64. Those skilled in the art will appreciate that various forms of seal mechanisms may be used to maintain sealed engagement between the mandrels 34 and 12 while withstanding both the high pressure differentials which may exist between the interior of the mandrel 34 and the well bore exterior of the mandrel, and also the corrosive fluids which may exist in the well bore. Any suitable type of seal assembly may be used in conjunction with the collet mechanism as described herein for forming an improved anchor assembly.

FIG. 2 illustrates in greater detail the pair of threads 44 and 21 on the latch or collet member, and the mating threads 42 and 22 on the mandrels 34 and 12, respectively. A variety of thread forms may be used for the threads 21 and 22 which interconnect the collet member and the packer mandrel 12, and suitable threads as shown in FIG. 2 have a slightly inclined top surface and a slightly inclined lower surface to interconnect the collet fingers 16 and the packer mandrel 12.

The threads as shown in FIG. 2 are positioned subsequent to the first but prior to the second ratcheting operations, i.e., for engagement of the second lowermost thread on thread se, t 21 with an uppermost thread on thread set 22. When the production tubing is moved further downward, the tapered surfaces on the threads 21 and 22 cause the collet fingers 16 to simultaneously move radially inward, so that the surface 78 is moved radially inward toward the surface 76. During this radially inward movement of the collet fingers, the mating surfaces 80 and 82 on the threads are in sliding engagement, so that inherently the surface 74 moves slightly toward surface 72. During the first ratcheting operation, the lowermost thread 21 moved in a ratcheting action from a position above the uppermost thread 22 to a position below the uppermost thread 22 and above the second thread 22. This same ratcheting action may thereafter be continued until all the threads on the collet fingers are in complete engagement with corresponding threads on the packer mandrel. The radial gap between surfaces 76 and 78 and the axial gap between surfaces 72 and 74 must be controlled to allow this ratcheting action to occur. The angle taper 84 on the surfaces 80 and 82 will typically be between 30° and 60°, preferably about 45°, so that the radial force generated during pick up of the production tubing string will approximate the generated axial force.

During this ratcheting action, the surface 48 on the collet mechanism will move closer to the surface 46. When ratcheting is complete, the surfaces 46 and 48 will still be spaced axially apart, and either the stop surfaces 36 and 40 will be in engagement, or the horizontal surfaces on the threads 42 and 44 will be in engagement, depending on the tolerances of components. To structurally fix the assembly 10 relative to the packer mandrel 12, the production tubing 14 may be picked up so that inclined or tapered upper surface 80 on thread 42 is brought into forced engagement with the inclined lower surface 82 on the thread 44 (the collet mechanism remains stationary with respect to the packer mandrel.) Engagement of these inclined thread surfaces 80 and 82 maintains a radially outward force on the collet fingers 16 to maintain the collet fingers in engagement with the packer mandrel. The magnitude of this radially outward force on the collet fingers will be a function of the axial pick up load on a production tubing and the taper of the inclined thread surfaces. The inclined thread surfaces also acts as a stop surface to effectively prohibit the collet fingers from moving radially inward while surfaces 80 and 82 are in forced engagement. A stop (not shown) may limit downward travel of tubing mandrel 34 relative to packer mandrel 12 when the collet to packer mandrel threads are fully made up.

The method of the present invention may be explained for interconnecting an upward extending mandrel of a set packer and the lower end of a production tubing string. The tubing string mandrel will have an interconnection member of some type, e.g., threads, for structurally interconnecting the tubing mandrel at the surface of the lower end of a production tubing string. The mandrel will support a collet mechanism as described herein having collet fingers with the first plurality of threads and the second plurality of threads. The latch assembly may be lowered into the well bore for engagement with the downhole packer mandrel. Subsequent to initial engagement of the anchor assembly with the packer, the production tubing string and thus the mandrel will be lowered or forced further downward, so that the anchor assembly moves into engagement with the stop surface to begin the ratcheting operation described above. ,Once ratcheting is complete, the tubing assembly is picked up to position the production tubing mandrel will respect to the collet mechanism as shown in FIG. 1, thereby securely locking the production tubing string to the packer in a manner in which allows high axial forces to be transmitted between the production tubing string and packer, yet does not exert a force which will tend to crush the upper packer mandrel. To subsequently disconnect the production tubing string and the packer, the production tubing string is merely rotated, thereby unthreading the collet mechanism from the set packer. During this unthreading operation, the normal thread connections of the production tubing string and the thread on the threaded connection between the tubing mandrel and the collet mechanism may be tightened, so that only the opposing thread between the collet mechanism and the packer mandrel will unthread. Alternatively, if straight or non-spiralling threads are used to interconnect the tubing mandrel and the collet mechanism, simple stops shown in FIG. 1 may engage to prohibit rotation between the tubing mandrel and the collet mechanism during this operation.

The threads between the collet mechanism and the set downhole tool may be conventional spiralling threads, so that the unthreading operation may be performed as discussed above. The threads in the collet mechanism and the tubing mandrel can also be conventional spiral threads which merely spiral in the opposing direction from the collet mechanism/downhole tool threads. Alternatively, however, the threads between the collet mechanism and the tubing mandrel may be "straight" or non-spiralling threads. Some form of stop such as keys 88 shown in FIG. 1 may be provided to prevent rotation of the collet mechanism with respect to the tubing mandrel during the unthreading operation. The collet mechanism and tubing mandrel "threads" may still be easily made up at the surface and will allow the ratcheting action discussed above to occur. Other mechanical interconnections between the collet mechanism and the tubing mandrel are possible, provided that this connection cooperates mechanically with the collet mechanism/packer mandrel threads to allow the ratcheting action to occur while also controllably limiting the radially inward forces applied to the downhole: tool mandrel while axial loads are transmitted through the anchor assembly, and simultaneously providing a large bearing surface area between the tubing mandrel and the collet mechanism to significantly reduce or effectively eliminate the likelihood of bearing failure.

Those skilled in the art: will appreciate that the radially inner and the radially outer threads on the collet mechanism are preferably at the same axial spacing, so that the outer threads on the collet: fingers disengage the packer mandrel threads during the ratcheting operation at substantially the same axial position where the inner threads on the collet fingers are pressed toward the threads on the production tubing mandrel. The inner and outer threads on the collet fingers could, however, be spaced axially from each other. Although preferably each of the plurality of collet fingers has both inner and outer threads, some of the collet fingers could have only inner threads and other of the collet fingers could have only outer threads. Also the frustoconical surface on the tubing mandrel and the corresponding surfaces at the end of the collet fingers provide a desired radial inward force to ensure that the collet mechanism will remain secured to the packer mandrel when the collet mechanism is in its locked or engaged position. The bearing surfaces on the collet fingers need not be provided, however, at the end of each collet finger. Also, another mechanical locking mechanism could be used to ensure that the collet fingers are prevented from radial inward movement with respect to the tubing mandrel when the collet mechanism is in its locked position.

While the anchor assembly of the present invention is typically used with a seal assembly as described herein, e.g., for sealing between the mandrels 34 and 12, in some applications a seal assembly may not be required. Also, those skilled in the art will appreciate that the techniques and equipment discussed herein may be used for latching the neck of a fixed downhole mandrel to a larger diameter tubular or overshot mandrel. In this case, the latch assembly may be lowered in the well bore from the end of a workstring, and the overshot mandrel latched to the smaller diameter fixed downhole mandrel. The interconnection could be broken as previously explained by merely rotating the workstring at the surface to unthread the overshot mandrel from the fixed downhole mandrel. Those skilled in the art will further appreciate that the term "mandrel" as used herein is intended in a broad sense to refer to any downhole tubular member, regardless of its axial length, which has a central bore hole therethrough.

Further modifications to the equipment and to the techniques described herein should be apparent from the above description of these preferred embodiments. Although the invention has thus been described in detail for a preferred embodiment, it should be understood that this explanation is for illustration, and that the invention is not limited to the described embodiments. Alternative equipment and operating techniques will thus be apparent to those skilled in the art in view of this disclosure. Modifications are thus contemplated and may be made without departing from the spirit of the invention, which is defined by the claims.

What is claimed is:

1. An anchor assembly for interconnecting one downhole tubular member affixed within a bore hole and another tubular member, the one downhole tubular member having axially spaced tubular member threads thereon, the assembly comprising:

a mandrel having an interconnection member for fixedly securing the mandrel to another tubular member;

mandrel threads fixed with respect to the mandrel; and a collet mechanism axially movable relative to the mandrel, the collet mechanism having a plurality of axially extending collet fingers, the collet fingers having a first plurality of threads for mating engagement with the tubular member threads and a second plurality of threads for mating engagement with the mandrel threads, the second plurality of threads being spaced radially from the first plurality of threads, and the plurality of collet fingers being radially movable with respect to the mandrel when the collet mechanism is in an unlocked position.

2. The anchor assembly as defined in claim 1, further comprising:

the collet mechanism being axially movable relative to the mandrel from the unlocked position to a locked position; and a tapered surface on the mandrel for engaging each of a plurality of collet fingers when collet mechanism is in the locked position to prevent radial movement of the plurality of collet fingers with respect to the mandrel.

3. The anchor assembly as defined in claim 2, wherein each of the collet fingers has a tapered collet surface for mating engagement with the tapered surface on the mandrel when the collet mechanism is in the locked position.

4. The anchor assembly as defined in claim 2, wherein the tapered surface on the mandrel is at an angle about 45° with respect to a centerline of the anchor assembly.

5. The anchor assembly as defined in claim 1, wherein the collet mechanism includes a collet ring supported on the mandrel and secured to the plurality of collet fingers.

6. The anchor assembly as defined in claim 1, further comprising:

a stop surface fixed with respect to the mandrel for limiting axial movement of the collet mechanism with respect to the mandrel when in the unlocked position.

7. The anchor assembly as defined in claim 1, further comprising:

a seal member for sealing engagement downhole between the mandrel and the downhole tubular member.

8. The anchor assembly as defined in claim 7, wherein the seal assembly is spaced axially from the collet mechanism.

9. The anchor assembly as defined in claim 1, wherein each of the second plurality of threads on the collet fingers has an inclined surface for sliding engagement with a corresponding inclined surface on a mandrel thread.

10. The anchor assembly as defined in claim 9, wherein the mandrel threads each have a thread surface spaced a selected radial distance from a thread surface on the plurality of collet fingers when the collet mechanism is in its locked position, such that the collet fingers may ratchet axially with respect to the threads on the one downhole tubular member when in the unlocked position.

11. An anchor assembly for interconnecting a large diameter tubular member affixed within a bore hole and a small diameter tubular, the large diameter tubular having axially spaced internal tubular member threads thereon, the assembly comprising:

a mandrel having an interconnection member for fixedly securing the mandrel to the small diameter tubular member, the mandrel having external mandrel threads; and a collet mechanism axially movable relative to the mandrel, the collet mechanism having a plurality of axially extending collet fingers, each collet finger having a first plurality of external threads for mating engagement with the internal tubular member threads and a second plurality of internal threads for mating engagement with the external mandrel threads, the second plurality of internal threads being spaced radially from the first plurality of external threads, and the plurality of collet fingers being radially movable with respect to the mandrel when the collet mechanism is in an unlocked position.

12. The anchor assembly as defined in claim 11, further comprising:

the collet mechanism being axially movable relative to the mandrel from the unlocked position to a locked position;

a tapered surface on the mandrel for engaging each of a plurality of collet fingers when collet mechanism is in the locked position to prevent radial movement of the plurality of collet fingers with respect to the mandrel; and a stop surface fixed with respect to the mandrel for limiting axial movement of the collet mechanism with respect to the mandrel when in the unlocked position.

13. The anchor assembly as defined in claim 11, further comprising:

a seal member for sealing engagement downhole between the mandrel and the downhole tubular member.

14. The anchor assembly as defined in claim 11, wherein;

each of the second plurality of threads on the collet fingers has an inclined surface for sliding engagement with a corresponding inclined surface on a mandrel thread; and the mandrel threads each have a thread surface spaced a selected radial distance from a thread surface on the plurality of collet fingers when the collet mechanism is in its locked position, such that the collet fingers may ratchet axially with respect to the threads on the large diameter tubular member when in the unlocked position.

15. A method of interconnecting one downhole tubular member affixed within a bore hole and another downhole tubular member, the one downhole tubular member having axially spaced tubular member threads thereon, the method comprising:

threadably interconnecting a mandrel at the surface and the other tubular member;

supporting a collet mechanism on and axially movable relative to the mandrel, the collet mechanism having a plurality of axially extending collet fingers, the collet fingers having a first plurality of threads for mating engagement with the tubular member threads and a second plurality of threads for mating engagement with the mandrel;

lowering the mandrel and the collet mechanism supported thereon into engagement with the one downhole tubular member;

thereafter further lowering the mandrel to force the collet fingers to move radially with respect to the mandrel as the collet fingers ratchet down the tubular member threads; and thereafter picking up the mandrel with respect to the collet mechanism to lock the collet mechanism and prevent further radial movement of the collet fingers with respect to the mandrel.

16. The method as defined in claim 15, wherein the step of picking up the mandrel further comprises:

engaging the collet fingers and a tapered surface on the mandrel to secure the collet mechanism in the locked position.

17. The method as defined in claim 15, wherein the step of thereafter further lowering the mandrel comprises:

limiting axial movement of the collet mechanism with respect to the mandrel when in the unlocked position.

18. The method as defined in claim 15, further comprising:

sealing the mandrel and the one downhole tubular member.

19. The method as defined in claim 15, wherein the step of supporting the collet mechanism comprises:

forming the first plurality of threads on an external surface of each of the plurality of collet fingers; and forming the second plurality of threads on an internal surface of each of the plurality of collet fingers.

20. The method as defined in claim 15, wherein the step of supporting the collet mechanism comprises:

positioning the first plurality of threads on the collet mechanism at an axial position of the second plurality of threads on the collet mechanism.

* * * * *